US012774511B2

(12) United States Patent
Toba et al.

(10) Patent No.: US 12,774,511 B2
(45) Date of Patent: Oct. 27, 2026

(54) Zn—Al—Mg-BASED HOT-DIP PLATED STEEL MEMBER

(71) Applicant: NIPPON STEEL CORPORATION, Tokyo (JP)

(72) Inventors: Tetsuya Toba, Tokyo (JP); Yasuaki Kawamura, Tokyo (JP); Tomohito Tanaka, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 19/149,771

(22) PCT Filed: Feb. 9, 2024

(86) PCT No.: PCT/JP2024/004685
§ 371 (c)(1),
(2) Date: Jul. 21, 2025

(87) PCT Pub. No.: WO2024/167020
PCT Pub. Date: Aug. 15, 2024

(65) Prior Publication Data

US 2026/0117357 A1 Apr. 30, 2026

(30) Foreign Application Priority Data

Feb. 9, 2023 (JP) ..... 2023-018261

(51) Int. Cl.
*C23C 2/06* (2006.01)
*C22C 18/04* (2006.01)
(Continued)

(52) U.S. Cl.
CPC ..... *C23C 2/06* (2013.01); *C22C 18/04* (2013.01); *C23C 2/022* (2022.08); *C23C 2/28* (2013.01)

(58) Field of Classification Search
CPC .. C23C 2/06; C23C 2/022; C23C 2/28; C22C 18/04
See application file for complete search history.

(56) References Cited

U.S. PATENT DOCUMENTS

2024/0043980 A1 2/2024 Tokuda et al.

FOREIGN PATENT DOCUMENTS

CN 103732780 A 4/2014
CN 112166206 A 1/2021
(Continued)

OTHER PUBLICATIONS

Pandovear et al., "Effect of hot galvanized steel sheet surface condition on paint film performance," Materials Protection, vol. 44, No. 3, Mar. 2011, pp. 68-70, with Machine Translation of Chinese Office Action.

*Primary Examiner* — Nathan T Leong
(74) *Attorney, Agent, or Firm* — Birch, Stewart, Kolasch & Birch, LLP

(57) ABSTRACT

The Zn—Al—Mg-based hot-dip plated steel member includes: a steel member; and a hot-dip plating layer arranged on a surface of the steel member, wherein the hot-dip plating layer includes, as an average composition, in terms of mass %, 4 to 22% of Al, 1.0 to 10.0% of Mg, 0.0001 to 2% of Fe, and a balance including Zn and impurities; in binarized image data of image data obtained by imaging a surface of the hot-dip plating layer, the total area ratio of white pixels is 30% or more and 70% or less; and the binarized image data is obtained by binarizing the image data by Otsu's method.

10 Claims, 2 Drawing Sheets

(51) Int. Cl.
*C23C 2/02* (2006.01)
*C23C 2/28* (2006.01)

(56) References Cited

FOREIGN PATENT DOCUMENTS

| | | | | |
|---|---|---|---|---|
| CN | 114729439 | A | | 7/2022 |
| JP | 2000-96202 | A | | 4/2000 |
| JP | 2004-143505 | A | | 5/2004 |
| JP | 2011-241458 | A | | 12/2011 |
| JP | 2015-193881 | A | | 11/2015 |
| KR | 10-2015-0135605 | A | | 12/2015 |
| TW | 567243 | B | | 12/2003 |
| TW | 202126834 | A | | 7/2021 |
| TW | 202242156 | A | | 11/2022 |
| WO | WO 2011/001662 | A1 | | 1/2011 |
| WO | WO 2019/230894 | A1 | | 12/2019 |
| WO | WO 2021/199953 | A1 | | 10/2021 |
| WO | WO2021199953 | | * | 12/2021 |

* cited by examiner

Zn—Al—Mg-BASED HOT-DIP PLATED STEEL MEMBER

TECHNICAL FIELD

The present invention relates to a Zn—Al—Mg-based hot-dip plated steel member. Priority is claimed on Japanese Patent Application No. 2023-018261, filed Feb. 9, 2023, the content of which is incorporated herein by reference.

BACKGROUND ART

A hot-dip plated steel member is used as a steel member having good corrosion resistance. A hot-dip galvanized steel sheet, which is a representative example of the hot-dip plated steel member, is widely used in various manufacturing industries such as the fields of automobiles, home appliances, and building materials.

A Zn—Al—Mg-based hot-dip galvanized steel member obtained by incorporating Al or Mg into a hot-dip galvanized layer has been proposed for the purpose of further improving the corrosion resistance of the hot-dip galvanized steel member. In addition, a technique for improving the external appearance of the plating surface of a Zn—Al—Mg-based hot-dip galvanized steel member has also been proposed.

Patent Document 1 describes a molten Zn-base plated steel sheet containing Mg, Al, and Zn and having an anti-glare property.

Patent Document 2 describes a Zn—Al—Mg-based hot-dip plated steel sheet having a satin skin with fine texture and many smooth glossy parts.

Patent Document 3 describes a hot-dip plated steel sheet containing Mg, Al, and Zn and having excellent external appearance quality.

CITATION LIST

Patent Document

Patent Document 1: Japanese Unexamined Patent Application, First Publication No. 2015-193881

Patent Document 2: PCT International Publication No. WO 2011/001662

Patent Document 3: Japanese Unexamined Patent Application, First Publication No. 2004-143505

SUMMARY OF INVENTION

Technical Problem

The hot-dip plated steel sheets described in Patent Documents 1 to 3 are techniques related to external appearance. However, in recent years, in addition to improvement in external appearance, there has been an increasing need for further improving corrosion resistance and improving adhesion of a chemical conversion treatment layer to improve corrosion resistance. In addition, in order to improve weldability in electric resistance welding such as spot welding, it is necessary to improve conductivity when a hot-dip plated steel sheet is in contact with a welding electrode. A hot-dip plated steel member is required to improve these characteristics in a well-balanced manner.

The present invention has been made in view of the above circumstances, and an object of the present invention is to provide a Zn—Al—Mg-based hot-dip plated steel member that is excellent in corrosion resistance and adhesion of a chemical conversion treatment layer, is also excellent in conductivity with a welding electrode even when a chemical conversion treatment layer is formed, and has an excellent external appearance in which defects are not easily noticeable.

Solution to Problem

In order to solve the above problems, the present invention employs the following configurations.

[1] A Zn—Al—Mg-based hot-dip plated steel member according to an embodiment of the present invention includes: a steel member; and a hot-dip plating layer arranged on a surface of the steel member, wherein the hot-dip plating layer includes, as an average composition, in terms of mass %, 4 to 22% of Al,
1.0 to 10% of Mg,
0.0001 to 2% of Fe,
0 to 2% of Si,
0 to 2% of Ni,
0 to 2% of Ti,
0 to 2% of Zr,
0 to 2% of Sr,
0 to 2% of Sb,
0 to 2% of Pb,
0 to 2% of Sn,
0 to 2% of Ca,
0 to 2% of Co,
0 to 2% of Mn,
0 to 2% of P,
0 to 2% of B,
0 to 2% of Bi,
0 to 2% of Cr,
0 to 2% of Sc,
0 to 2% of Y,
0 to 2% of REM,
0 to 2% of Hf,
0 to 2% of C, and
a balance including Zn and impurities;

in binarized image data of image data obtained by imaging a surface of the hot-dip plating layer, the total area ratio of white pixels is 30% or more and 70% or less; and the binarized image data is obtained by binarizing the image data by Otsu's method.

[2] In the Zn—Al—Mg-based hot-dip plated steel member according to [1], a chemical conversion treatment layer may be included on a surface of the hot-dip plating layer.

[3] In the Zn—Al—Mg-based hot-dip plated steel member according to [2], the chemical conversion treatment layer may have a metallic external appearance.

[4] In the Zn—Al—Mg-based hot-dip plated steel member according to [1], optionally, a 60 degree specular gloss Gs (60°) of a surface of the hot-dip plating layer corresponding to an aggregate region of the white pixels is 150 or less; and a 60 degree specular gloss Gs (60°) of a surface of the hot-dip plating layer corresponding to an aggregate region of black pixels is 1.5 times or more the 60 degree specular gloss Gs (60°) of a surface of the hot-dip plating layer corresponding to an aggregate region of the white pixels.

[5] In the Zn—Al—Mg-based hot-dip plated steel member according to [2], optionally, a 60 degree specular gloss Gs (60°) of a surface of the hot-dip plating layer corresponding to an aggregate region of the white pixels is 150 or less; and a 60 degree specular gloss Gs (60°) of a surface of the hot-dip plating layer corresponding to an aggregate region of black pixels is 1.5 times or more the 60 degree specular gloss Gs (60°) of a surface of the hot-dip plating layer corresponding to an aggregate region of the white pixels.

[6] In the Zn—Al—Mg-based hot-dip plated steel member according to [1], optionally, a 60 degree specular gloss Gs (60°) of a surface of the hot-dip plating layer corresponding to an aggregate region of the white pixels is 70 or less; and a 60 degree specular gloss Gs (60°) of a surface of the hot-dip plating layer corresponding to an aggregate region of black pixels is 1.5 times or more the 60 degree specular gloss Gs (60°) of a surface of the hot-dip plating layer corresponding to an aggregate region of the white pixels.

[7] In the Zn—Al—Mg-based hot-dip plated steel member according to any one of [1] to [6], the hot-dip plating layer may include, as the average composition, one or two or more selected from groups A, B, and C below:

Group A: 0.0001 to 2 mass % of Si,

Group B: 0.0001 to 2 mass % in total of any one or two or more of Ni, Ti, Zr, and Sr, and Group C: 0.0001 to 2 mass % in total of any one or two or more of Sb, Pb, Sn, Ca, Co, Mn, P, B, Bi, Cr, Sc, Y, REM, Hf, and C.

[8] In the Zn—Al—Mg-based hot-dip plated steel member according to [5], the hot-dip plating layer may include, as the average composition, the group A.

[9] In the Zn—Al—Mg-based hot-dip plated steel member according to [5], the hot-dip plating layer may include, as the average composition, the group B.

[10] In the Zn—Al—Mg-based hot-dip plated steel member according to [5], the hot-dip plating layer may include, as the average composition, the group C.

Advantageous Effects of Invention

According to the present invention, it is possible to provide a Zn—Al—Mg-based hot-dip plated steel member that is excellent in corrosion resistance and adhesion of a chemical conversion treatment layer, is also excellent in conductivity with a welding electrode even when a chemical conversion treatment layer is formed, and has an excellent external appearance in which defects are not easily noticeable.

DESCRIPTION OF EMBODIMENTS

Figure 1:
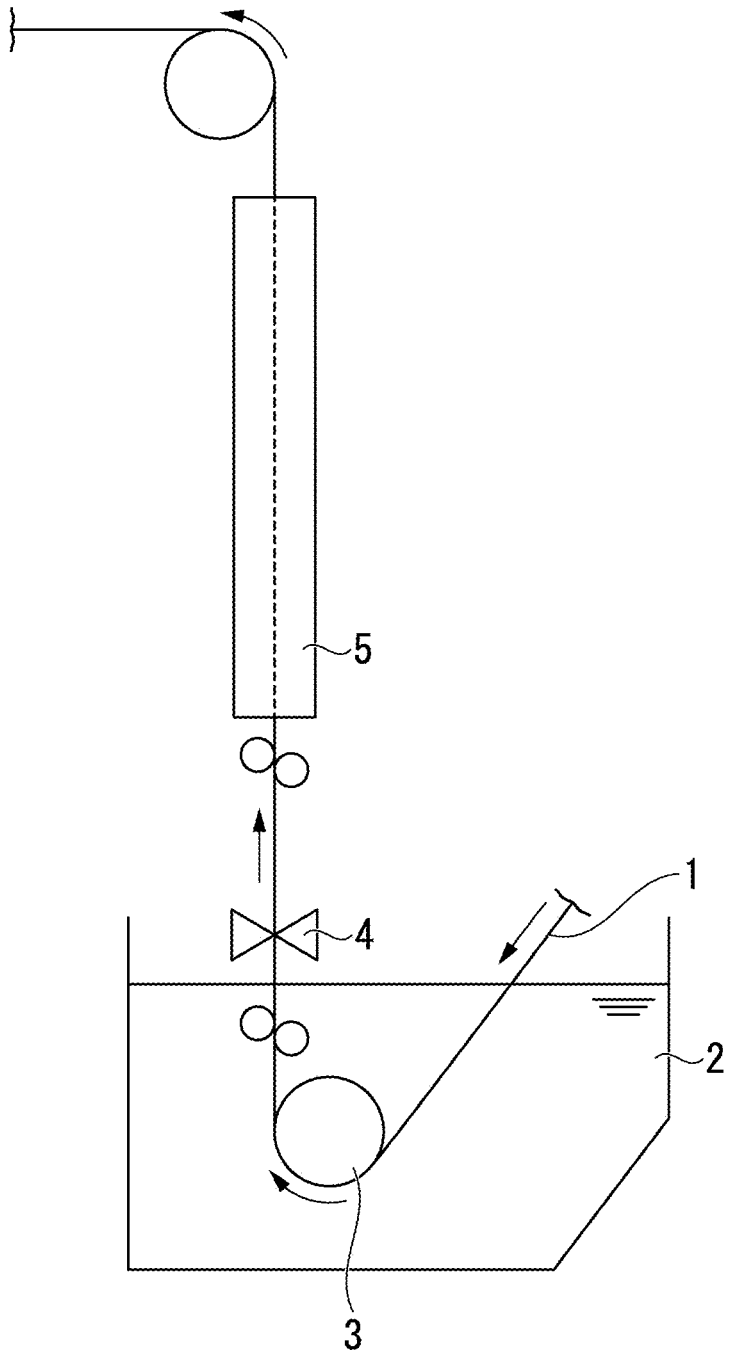
FIG. 1 A schematic view for illustrating a manufacturing method of a Zn—Al—Mg-based hot-dip plated steel member.

The hot-dip plating layer of the Zn—Al—Mg-based hot-dip plated steel member has a satin-like external appearance. The satin-like external appearance appears when fine white portions and glossy portions are mixed in the surface of the hot-dip plating layer. In the white portion, since the surface roughness is relatively large, the incident light is diffusely reflected, so that the portion looks white or a color close to white. On the other hand, in the glossy portion, since the surface roughness is relatively small, the incident light is less likely to be diffusely reflected, thereby exhibiting metallic gloss or a form close to metallic gloss. As the number of white portions increases, defects become less noticeable.

Here, when a chemical conversion treatment layer is formed on the hot-dip plating layer, the chemical conversion treatment layer is generally formed such that the height of the surface of the chemical conversion treatment layer is substantially uniform over the entire hot-dip plating layer.

In this case, when the number of white portions in the hot-dip plating layer increases, the surface roughness of the hot-dip plating layer increases as a whole, so that the adhesion of the chemical conversion treatment layer is enhanced by the anchor effect. In addition, since the surface roughness of the hot-dip plating layer is large, the chemical conversion treatment layer tends to be formed relatively thick. Accordingly, the corrosion resistance of the hot-dip plating layer tends to be improved.

On the other hand, when the number of glossy portions in the hot-dip plating layer increases, the surface roughness of the entire hot-dip plating layer decreases, so that the chemical conversion treatment layer can be relatively thin. As a result, when a welding electrode is pressed against the hot-dip plated steel sheet, the conductivity between the welding electrode and the hot-dip plating layer is improved. For this reason, a hot-dip plating layer having many glossy portions is improved in weldability in electric resistance welding such as spot welding.

From the above, it is considered that when the ratio between the white portion and the glossy portion of the hot-dip plating layer can be adjusted within an appropriate range, an excellent external appearance in which defects are not easily noticeable, the corrosion resistance of the hot-dip plating layer, adhesion between the hot-dip plating layer and the chemical conversion treatment layer, and conductivity between the hot-dip plating layer and the welding electrode can be provided. However, it has been conventionally difficult to obtain a hot-dip plating layer satisfying all of these conditions.

Therefore, the present inventors further studied, and found a phenomenon in which surface oxidation of the hot-dip plating layer is promoted and white portions are easily formed in the surface of the hot-dip plating layer when an oxygen-added air refrigerant is sprayed from a cooling device including a plurality of jetting nozzles to form a hot-dip plating layer on the surface of a steel member such as a steel sheet. Here, the present inventors found that when a refrigerant is jetted, the refrigerant is not jetted from all the jetting nozzles at the same time, but the jetting nozzles for jetting the refrigerant are randomly switched while the refrigerant is jetted from some of the jetting nozzles, whereby an excellent external appearance in which defects are not easily noticeable, corrosion resistance, adhesion to a chemical conversion treatment layer, and conductivity to a welding electrode can be simultaneously satisfied. Furthermore, the present inventors also found that when digital image of the hot-dip plating layer having the features is binarized by a binarization method called "Otsu's method" used for image binarization processing, the obtained binarized image including white pixels and black pixels has the total area ratio of the white pixels within a predetermined range. That is, according to the plated steel sheet in which the total area ratio of the white pixels is in a predetermined range in the above binarized image, an excellent external appearance in which defects are not easily noticeable, corrosion resistance, adhesion to a chemical conversion treatment layer, and conductivity to a welding electrode can be simultaneously satisfied.

Hereinafter, the Zn—Al—Mg-based hot-dip plated steel member of the embodiment will be described.

The Zn—Al—Mg-based hot-dip plated steel member of the embodiment (hereinafter, referred to as hot-dip plated steel member) includes: a steel member; and a hot-dip plating layer arranged on the surface of the steel member, wherein the hot-dip plating layer includes, as an average composition, in terms of mass %, 4 to 22 mass % of Al, 1.0 to 10 mass % of Mg, 0.0001 to 2% of Fe, and a balance including Zn and impurities; and in binarized image data of image data obtained by imaging the surface of the hot-dip plating layer, the total area ratio of white pixels is 30% or more and 70% or less.

The hot-dip plated steel member of the embodiment may further have a chemical conversion treatment layer on the surface of the hot-dip plating layer.

In addition, in binarized image data of image data obtained by imaging the surface of the hot-dip plating layer from above the chemical conversion treatment layer, the total area ratio of the white pixels may be 30% or more and 70% or less, and a metallic external appearance may be exhibited.

The steel member as the base of the hot-dip plating layer is, for example, a steel sheet, a steel material, or a member obtained by processing these, but the material thereof is not particularly limited. Although details will be described later, general steel or the like can be used as the material of the steel member without particular limitation, and Al killed steel or some high alloy steel can also be applied. The shape of the steel member is also not particularly limited. The hot-dip plating layer of the embodiment is formed by applying the hot-dip plating method described later to the steel member. The hot-dip plating layer is formed on the surface of the steel member. That is, when the steel member is a steel sheet, the hot-dip plating layer is formed on both surfaces of the steel sheet. The steel member includes not only a steel sheet and a steel material, but also a member obtained by processing these. The steel member may be, for example, a steel product used in the fields of automobiles, home appliances, building materials, and the like.

Next, the chemical composition of the hot-dip plating layer will be described.

The hot-dip plating layer includes, as an average composition, in terms of mass %, 4 to 22% of Al, 1.0 to 10% of Mg, 0.0001 to 2% of Fe, and a balance including Zn and impurities. The hot-dip plating layer may be composed of, as an average composition, 4 to 22% of Al, 1.0 to 10% of Mg, 0.0001 to 2% of Fe, and a balance including Zn and impurities.

The hot-dip plating layer may include, as an average composition, one or two or more selected from groups A, B, and C below. In the chemical composition of the hot-dip plating layer, the lower limit of each element in the groups A, B, and C below may be 0%, or may be more than 0%. The hot-dip plating layer may include, as an average composition, 4 to 22% of Al, 1.0 to 10% of Mg, 0.0001 to 2% of Fe, further include one or two or more selected from groups A, B, and C below, and include a balance including Zn and impurities.

Group A: 0.0001 to 2 mass % of Si

Group B: 0.0001 to 2 mass % in total of any one or two or more of Ni, Ti, Zr, and Sr Group C: 0.0001 to 2 mass % in total of any one or two or more of Sb, Pb, Sn, Ca, Co, Mn, P, B, Bi, Cr, Sc, Y, REM, Hf, and C The composition of the hot-dip plating layer can be measured by the following method. First, a sample is collected from the hot-dip plated steel sheet by cutting a 50 mm×50 mm rectangular region that is 50 mm distant from the edge and has no obvious defect such as corrosion. Next, using a coating film release agent that does not erode the plating layer (for example, NEOREVER SP-751, manufactured by SANSAIKAKO), the coating film layer and the chemical conversion treatment layer as the surface layer are removed from the sample. When the coating film layer and the chemical conversion treatment layer as the surface layer are insufficiently removed, they are removed in combination with polishing with a polishing agent that is less hard than the plating layer. Thereafter, the sample is immersed in 5% hydrochloric acid containing an inhibitor (for example, HIBIRON, manufactured by SUGIMURA Chemical Industrial Co., Ltd.) to dissolve the hot-dip plating layer. The composition of the hot-dip plating layer can be determined by subjecting the obtained solution to inductively coupled plasma (ICP) emission spectrometry. However, Si cannot be accurately analyzed by the above method. The Si content can be determined by analyzing the obtained solution after treatment by Decomposition with acids and fusion with sodium carbonate based on JIS G1258-3.

The Al content is 4 to 22 mass % in average composition. Al is an element necessary for ensuring corrosion resistance. When the Al content in the hot-dip plating layer is less than 4 mass %, the effect of improving corrosion resistance is insufficient, and when the Al content is more than 22 mass %, the effect of improving corrosion resistance is saturated. From the viewpoint of corrosion resistance, the Al content is preferably 5 to 20 mass %. The Al content is more preferably 6 to 20 mass %.

The Mg content is 1.0 to 10 mass % in average composition. Mg is an element necessary for improving corrosion resistance. When the Mg content in the hot-dip plating layer is less than 1.0 mass %, the effect of improving corrosion resistance is insufficient. When the Mg content in the hot-dip plating layer exceeds 10 mass %, dross in the plating bath is significantly generated, and it becomes difficult to stably produce a hot-dip plated steel member. From the viewpoint of the balance between corrosion resistance and dross generation, the Mg content is preferably 1.5 to 8 mass %. The Mg content is more preferably 2.0 to 7.0 mass %.

The hot-dip plating layer may include Si in a range of 0.0001 to 2 mass % as an element in the group A. Si is an element effective for improving the adhesion of the hot-dip plating layer. When Si is included in an amount of 0.0001 mass % or more, the effect of improving the adhesion of the hot-dip plating layer is exhibited, and therefore Si is preferably included in an amount of 0.0001 mass % or more. On the other hand, even when Si is included in an amount of more than 2 mass %, the effect of improving plating adhesion is saturated, so that the Si content is 2 mass % or less. From the viewpoint of plating adhesion, the Si content is more preferably 0.0010 to 1 mass %, and still more preferably 0.0100 to 0.8 mass %. The Si content may be 0%, or may be more than 0%.

The hot-dip plating layer may include, as an average composition, 0.0001 to 2 mass % in total of any one or two or more of Ni, Ti, Zr, and Sr, as an element in the group B. The amount is more preferably 0.001 to 1 mass %, and still more preferably 0.002 to 0.10 mass %. When these elements in the group B are included, corrosion resistance can be further improved. The content of Ni, Ti, Zr, and Sr may be 0%, or may be more than 0%.

The hot-dip plating layer may include, as an average composition, 0.0001 to 2 mass % in total of any one or two or more of Sb, Pb, Sn, Ca, Co, Mn, P, B, Bi, Cr, Sc, Y, REM, Hf, and C, as an element in the group C. The amount is more preferably 0.001 to 1 mass %, and still more preferably 0.002 to 0.10 mass %. When these elements in the group C are included, corrosion resistance can be further improved. REM is one or two or more of rare earth elements having an atomic number of 57 to 71 in the periodic table. The amount of Sb, Pb, Sn, Ca, Co, Mn, P, B, Bi, Cr, Sc, Y, REM, Hf, and C may be 0%, or may be more than 0%.

The balance of the chemical composition of the hot-dip plating layer includes zinc and impurities. When the hot-dip plating layer is formed, Fe (iron), which is a main component of the steel member, is mixed into the hot-dip plating layer. In the hot-dip plating layer in the embodiment, the Fe content is, as an average composition, in a range of 0.0001 to 2 mass %.

Next, the external appearance of the hot-dip plating layer will be described. In the hot-dip plating layer of the embodiment, when image data obtained by imaging the surface of the hot-dip plating layer is binarized by Otsu's method to obtain binarized image data, the total area ratio of white pixels included in the binarized image data is 30% or more and 70% or less. When the steel member has a sheet shape having an upper surface and a lower surface like a steel sheet, the binarized image data may be obtained by using Otsu's method and binarizing the image data obtained by imaging from a first surface side or both surface side of the steel member (steel sheet) among the image data obtained by imaging the surface of the hot-dip plating layer.

Here, the "image data obtained by imaging from a first surface side or both surface side of the steel member (steel sheet) among the image data obtained by imaging the surface of the hot-dip plating layer" will be supplementarily described. When the steel member is a steel sheet, the hot-dip plating layer of the embodiment is formed on the surface of the steel sheet, that is, on the first surface side and a second surface side in the sheet thickness direction of the steel sheet. In such a case, the image data to be binarized may be data obtained by imaging the surface of either side of the hot-dip plating layers arranged on the first surface side and the second surface side, or may be data obtained by imaging both surfaces of the hot-dip plating layers arranged on the first surface side and the second surface side.

That is, in the hot-dip plated steel member of the embodiment, 30% or more and 70% or less may be satisfied by the total area ratio of white pixels included in binarized image data obtained from image data obtained by imaging the steel member from the first surface side, among image data obtained by imaging the surface of the hot-dip plating layer.

Alternatively, 30% or more and 70% or less may be satisfied by the total area ratio of white pixels included in binarized image data obtained from image data obtained by imaging the steel member from both surface sides, among image data obtained by imaging the surface of the hot-dip plating layer.

When the image data is captured in a case where the shape of the hot-dip plated steel member of the embodiment is not a sheet shape (for example, in a case of a processed member), the flat portion of the steel member may be captured.

The imaging region for obtaining image data of the surface of the hot-dip plating layer is selected by cutting a 100 mm×100 mm rectangular region that is 50 mm distant from the edge and has no obvious defect such as corrosion. When the hot-dip plated steel member is a processed product, the imaging region is selected by cutting a 100 mm×100 mm rectangular flat portion that is 50 mm distant from the edge or the processed portion. When the imaging region is narrower than this, the external appearance of the hot-dip plating layer is difficult to appropriately evaluate. In addition, when the imaging region is larger than this, the data amount increases and the processing time increases, which is not preferable.

A sample including the selected imaging region and its periphery is cut out from the hot-dip plated steel member, and image data of the imaging region is obtained using the sample.

The image data is acquired by scanning the surface of the hot-dip plating layer of the sample with a scanner connected to a computer. The image data is extracted as, for example, image data of 256 gradation in gray scale with a resolution of 300 dpi (dot per inch). The scanner to be used is, for example, a flatbed scanner. When a local brightness spot occurs in the image data due to the influence of distortion of the steel member or the like, the local brightness spot is preferably eliminated by image correction.

In general, image data can be extracted also by photographing with a camera. However, in the case of photographing with a camera, it is difficult to completely uniformly irradiate the entire hot-dip plating layer as a subject with illumination light at the time of photographing, and there is a possibility that the external appearance pattern cannot be accurately evaluated. Therefore, image data is preferably extracted with a scanner.

The image data is image data of 256 gradation in gray scale. The image data includes color image data in addition to gray scale, but color image data has an excessive information amount due to pixels having color information. Since the surface external appearance of the hot-dip plating layer of the embodiment has low saturation, gray scale gradation image data is sufficient as information amount. Therefore, in the embodiment, preferable is image data of 256 gradation in gray scale, having an appropriate information amount and having 0 to 255 stage gradation, which is easily handled by computer.

The image data is preferably image data under visible light as a light source, and is preferably other than a secondary electron image or a reflected electron image of an electron microscope. The secondary electron image and the reflected electron image of an electron microscope are convenient for finely observing the surface shape and observing the difference in elemental composition, but cannot obtain color information of an object at all. On the other hand, the image data of the embodiment, converted to gray scale, can incorporate the color information of the plating layer surface to reflect the impression when the plating layer is observed with the naked eye under visible light.

Next, the obtained image data is binarized by Otsu's method to obtain binarized image data. The binarization by Otsu's method may be performed by a computer incorporating the program in advance.

Otsu's method is generally known as a method of binarizing light and shade image and selecting the threshold level to separate the image into a target region and a background. The document below describes the method in detail.

The amounts will be briefly described below.

Nobuyuki Otsu, "*An Automatic Threshold Selection Method Based on Discriminant and Least Squares Criteria*", The transactions of the Institute of Electronics, Information and Communication Engineers. D, vol. 63, No. 4, pp. 349-356, 1980

Now, there is a gray scale gradation image with 256 stages (0 to 255). The universal set of pixels in the entire image is defined as U. Using k in the range of 0 to 255 as a threshold, the set of pixels having pixel values of 0 to k is defined as A, and the set of pixels having pixel values of k+1 to 255 is defined as B. The total number of each of U, A, and B is defined as N, NA, and NB, and the average pixel value of each of U, A, and B is defined as x, XA, and XB. Next, Y is defined as in the following formula. At this time, the gradation image is binarized with k that maximizes Y. The method above is the same as Otsu's method. The Y below corresponds to the formula (16) in the above document.

$$Y = (N_A / N)(x_A - x)^2 + (N_B / N)(x_B - x)^2$$

In the embodiment, in the binarized image data after binarization, pixels included in the set A of pixels having pixel values of 0 to k become black pixels, and pixels included in the set B of pixels having pixel values of k+1 to 255 become white pixels. In a satin external appearance, the black pixels correspond to the glossy portion, and the white pixels correspond to the white portion.

In the embodiment, the total area ratio of the white pixels in the binarized image data of the hot-dip plating layer is necessarily in the range of 30% or more and 70% or less. When the total area ratio of the white pixels is less than 30%, the region of the black pixels becomes excessively large, that is, the region of the glossy portion becomes wide, and defects on the surface of the hot-dip plating layer also become conspicuous. In addition, the weldability of electric resistance welding such as spot welding is improved, but the adhesion of the chemical conversion treatment layer and the corrosion resistance of the hot-dip plating layer are deteriorated.

On the other hand, when the total area ratio of the white pixels is more than 70%, the region of the white pixels becomes excessively large, that is, the region of the white portion becomes wide, defects become less noticeable, and the adhesion of the chemical conversion treatment layer and the corrosion resistance of the hot-dip plating layer are improved, but the weldability of electric resistance welding such as spot welding is deteriorated. Therefore, the total area ratio of the white pixels is preferably in the range of 30% or more and 70% or less. Such a hot-dip plating layer has a satin external appearance in which the glossy portion and the white portion are mixed. In addition, the hot-dip plating layer has a metallic external appearance having a metal texture.

In the hot-dip plating layer of the embodiment, the 60 degree specular gloss Gs (60°) of the surface of the hot-dip plating layer corresponding to the aggregate region of the white pixels is 150 or less, and preferably 70 or less. The 60 degree specular gloss Gs (60°) of the surface of the hot-dip plating layer corresponding to the aggregate region of black pixels is preferably 1.5 times or more, more preferably 2.1 times or more, the 60 degree specular gloss Gs (60°) of the surface of the hot-dip plating layer corresponding to the aggregate region of the white pixels. When a chemical conversion treatment layer having visible light permeability is formed on the hot-dip plating layer and the chemical conversion treatment layer is difficult to remove, the glossiness may be measured from above the chemical conversion treatment layer.

Figure 2:
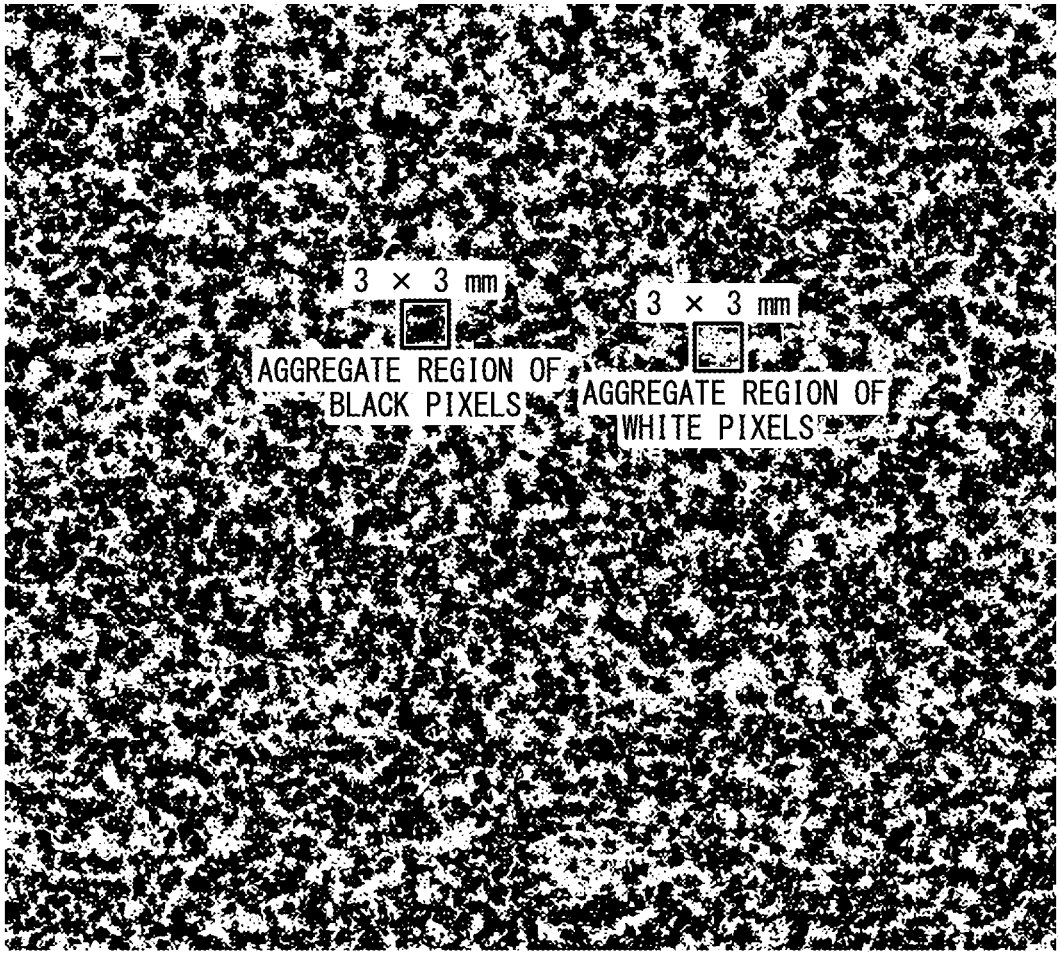
FIG. 2 Image data for illustrating aggregate regions of each of white pixels and black pixels, which is binarized image data obtained by binarizing image data by Otsu's method, the image data obtained by imaging the surface of a hot-dip plating layer.

The aggregate region of white pixels is a pixel region in which white pixels aggregate in a region having such a size that the 60 degree specular gloss Gs (60°) can be measured by a gloss meter. Specifically, as illustrated in FIG. 2, the aggregate region of white pixels indicates a rectangular region of 3 mm square, the region including white pixels in an area ratio of 60% or more. In other words, when white pixels are included in an area ratio of 60% or more within the rectangular region of 3 mm square, the region is defined as the aggregate region of white pixels. Similarly, the aggregate region of black pixels is a pixel region in which black pixels aggregate, and indicates a rectangular region of 3 mm square, the region including black pixels in an area ratio of 60% or more, as shown in FIG. 2. In other words, when black pixels are included in an area ratio of 60% or more within the rectangular region of 3 mm square, the region is defined as the aggregate region of black pixels.

Within the surface of the hot-dip plating layer, the 60 degree specular gloss Gs (60°) of the surface of the hot-dip plating layer corresponding to the aggregate region of the white pixels is preferably 150 or less, and more preferably 70 or less. As a result, it is possible to obtain a good external appearance having a calm atmosphere, without excessively emphasizing metallic gloss. When the 60 degree specular gloss Gs (60°) is measured for the aggregate region of the white pixels, the lower limit is not particularly limited, but may be 10 or more. The "60 degree specular gloss Gs (60°) of the surface of the hot-dip plating layer corresponding to the aggregate region of the white pixels" mentioned here indicates the average value of the 60 degree specular gloss Gs (60°) in each of 10 aggregate regions of white pixels. The same applies to the 60 degree specular gloss Gs (60°) of the surface of the hot-dip plating layer corresponding to the aggregate region of black pixels.

In the hot-dip plating layer, the 60 degree specular gloss Gs (60°) of the surface of the hot-dip plating layer corresponding to the aggregate region of black pixels is preferably 1.5 times or more the 60 degree specular gloss Gs (60°) of the surface of the hot-dip plating layer corresponding to the aggregate region of the white pixels. As a result, when an aggregate region of white pixels and an aggregate region of black pixels are adjacent to each other, the contrast in external appearance between the white portion corresponding to the aggregate region of white pixels and the glossy portion corresponding to the aggregate region of black pixels is clarified, so that the surface pattern can be felt as a good impression.

The 60 degree specular gloss Gs (60°) of the surface of the hot-dip plating layer is measured using a gloss meter in accordance with the method defined in JIS Z 8741. Specifically, the 60° glossiness (%) is measured by the method defined in JIS Z 8741, and Gs (60°) is calculated based on the obtained glossiness (%). When the 60 degree specular gloss Gs (60°) is measured, that is, the aggregate region of white pixels or black pixels is specified, the measurement targets, each rectangular region of 3 mm square, are set such that they are not overlapped with each other.

The hot-dip plated steel member of the embodiment may have a chemical conversion treatment layer on the surface of the hot-dip plating layer. The chemical conversion treatment layer is not necessarily provided on the entire steel member. For example, in the case of a steel sheet, the chemical conversion treatment layer may be provided on both hot-dip plating layers arranged on the first surface side and the second surface side of the steel sheet. The type of the chemical conversion treatment is not particularly limited, and a known chemical conversion treatment may be used. However, the chemical conversion treatment layer in this case is preferably a chemical conversion treatment layer having transparency to visible light.

As to the hot-dip plating layer of the hot-dip plated steel member including a chemical conversion treatment layer, when the surface of the hot-dip plating layer is imaged from above the chemical conversion treatment layer to obtain image data, and the image data is binarized by Otsu's method to obtain binarized image data, the binarized image data includes white pixels in the total area ratio of 30% or more and 70% or less. That is, the chemical conversion treatment layer provided on the hot-dip plated steel member of the embodiment preferably has no influence on the external appearance of the surface of the hot-dip plating layer. The hot-dip plated steel member on which such a chemical conversion treatment layer is arranged has a metallic external appearance. When a coating film layer is formed on the surface of the hot-dip plating layer or the surface of the chemical conversion treatment layer, the hot-dip plated steel member after the hot-dip plating layer is formed or after the chemical conversion treatment layer is formed is subjected to a coating treatment. The type of the coating treatment is not particularly limited, and a known coating treatment can be used. The coating treatment in this case is preferably a coating treatment having transparency to visible light.

Examples of the chemical conversion treatment layer of the embodiment include a layer containing 20 mass % or more of a resin and 1 to 20 mass % of a silica particle having a particle diameter of 5 to 200 nm. This chemical conversion treatment layer is obtained by applying an aqueous composition containing a resin and a silica particle to the hot-dip plating layer and drying the aqueous composition.

The resin contained in the chemical conversion treatment layer may be a general resin. Examples thereof include a polyolefin resin, a fluororesin, an acrylic resin, a urethane resin, a polyester resin, an epoxy resin, and a phenol resin. These resins may be a water-soluble resin or a resin that is originally water-insoluble but can be finely dispersed in water like emulsion and suspension (water-dispersible resin). In addition to the water-soluble resin, a resin that is originally water-insoluble but can be finely dispersed in water like emulsion and suspension (water-dispersible resin) is included. In particular, any one or more resins of a polyolefin resin, a fluororesin, an acrylic resin, and a phenol resin are preferably contained because they are excellent in weather resistance.

The resin is preferably contained in the chemical conversion treatment layer in a proportion of 20 mass % or more. When the amount of the resin is 20 mass % or more, the chemical conversion treatment layer itself is not brittle, and the hot-dip plating layer can be stably coated. While the chemical conversion treatment layer may contain components other than a resin, such as an Nb compound and a phosphate compound, together with a resin, a silica particle, and a pigment, the amount of the resin may be the balance of these components.

The silica particle is blended to improve the corrosion resistance of the chemical conversion treatment layer. As the silica particle, those having an average particle diameter in a range of 5 to 200 nm are suitable. The silica particle is contained in the chemical conversion treatment layer in a proportion of 1 to 20 mass %. When the amount of the silica particle is 1 mass % or more, an effect of improving corrosion resistance can be obtained. When the amount of the silica particle is 20 mass % or less, the chemical conversion treatment layer itself is not brittle, and the Zn-based plating layer can be stably coated. A silica particle having an average particle diameter of less than 5 nm is difficult to obtain, and a chemical conversion treatment layer containing a silica particle having an average particle diameter of less than 5 nm is practically difficult to prepare and produce. Therefore, the lower limit of the average particle diameter of the silica particle is 5 nm or more. In addition, when the average particle diameter of the silica particle exceeds 200 nm, the chemical conversion treatment layer may be clouded, and the metallic external appearance of the hot-dip plating layer may be impaired.

In general, an inorganic pigment such as a silica particle has a small particle diameter, and therefore may be present in the chemical conversion treatment layer in the form of secondary particles having a particle diameter larger than the primary particle diameter. The particle diameter of the secondary particles (particles in which inorganic pigments are aggregated) is hereinafter referred to as "secondary particle diameter". In the silica particle in the embodiment, primary particles and secondary particles may be mixed. Even when primary particles and secondary particles are mixed, the average particle diameter may be in the range of 5 to 200 nm.

In order to improve the corrosion resistance of the chemical conversion treatment layer, a titania particle, an alumina particle, a zirconia particle, and the like may be contained in addition to the silica particle.

The chemical conversion treatment layer may further contain any one or both of an Nb compound and a phosphate compound. When the Nb compound or the phosphate compound are contained, the corrosion resistance of the Zn-based plating layer is improved.

As the Nb compound, a conventionally known niobium-containing compound can be used. Examples thereof include niobium oxide, niobic acid and a salt thereof, fluoro-niobate, and fluoro-oxo-niobate. Among them, niobium oxide is preferable from the viewpoint of improving corrosion resistance.

Examples of the phosphate compound include phosphoric acids such as orthophosphoric acid, metaphosphoric acid, pyrophosphoric acid, triphosphoric acid, and tetra phosphoric acid, and salts thereof; phosphonic acids such as aminotri (methylenephosphonic acid), 1-hydroxyethylidene-1,1-diphosphonic acid, ethylenediaminetetra (methylenephosphonic acid), and diethylenetriaminepenta (methylenephosphonic acid), and salts thereof; and organic phosphoric acids such as phytic acid and salts thereof. The cation species of the salts is not particularly limited. Examples thereof include Cu, Co, Fe, Mn, Sn, V, Mg, Ba, Al, Ca, Sr, Nb, Y, Ni, and Zn. These may be used singly or in combination of two or more kinds thereof.

The Nb compound and the phosphate compound may be contained in the chemical conversion treatment layer in a proportion of 0.5 to 30 mass % in total. When the amount is 0.5 mass % or more, the effect of improving corrosion resistance is obtained, and when the amount is 30 mass % or less, the chemical conversion treatment layer is not brittle, and the Zn-based plating layer can be stably coated.

The adhesion amount of the chemical conversion treatment layer per one surface of the hot-dip plating layer is preferably 0.1 to 15 $g/m^2$. When the adhesion amount is 0.1 $g/m^2$ or more, the adhesion amount of the chemical conversion treatment layer becomes sufficient, the blackened portion in the surface of the hot-dip plating layer can be made inconspicuous, and the corrosion resistance of the hot-dip plating layer can be further improved. When the adhesion amount is 15 g/m$^2$ or less, light reflection on the surface of the chemical conversion treatment layer is reduced, and the metallic external appearance of the surface of the hot-dip plating layer can be visually observed. The adhesion amount is further preferably 0.2 to 2 g/m$^2$.

The chemical conversion treatment layer may further contain at least one crosslinking agent selected from the group consisting of a silane coupling agent, a crosslinkable zirconium compound, and a crosslinkable titanium compound. These may be used singly or in combination of two or more kinds thereof.

The chemical conversion treatment layer of the hot-dip plated steel member of the embodiment is not limited to those described above, and it goes without saying that, for example, a known chemical conversion treatment layer may be used.

Next, the manufacturing method of the hot-dip plated steel member according to the embodiment will be described. FIG. 1 shows a hot-dip plating facility suitable for manufacturing the hot-dip plated steel member of the embodiment. The hot-dip plating facility illustrated in FIG. 1 includes a hot-dip plating bath 2, a sink roll 3 arranged in the hot-dip plating bath 2, a pair of wiping nozzles 4 arranged above the hot-dip plating bath 2, a cooling device 5 arranged above at least one wiping nozzle 4 of the pair of wiping nozzles 4, and a top roll 7 arranged above the cooling device 5. The cooling device 5 may be arranged above both of the pair of wiping nozzles 4.

The hot-dip plating bath 2 contains, in terms of mass %, 4 to 22% of Al, 1.0 to 10% of Mg, and a balance including Zn and impurities. Further, the hot-dip plating bath may contain 0.0001 to 2 mass % of Si. Furthermore, the hot-dip plating bath may contain any one or two or more of Ni, Ti, Zr, and Sr in a total amount of 0.0001 to 2 mass %. The hot-dip plating bath may contain any one or two or more of Sb, Pb, Sn, Ca, Co, Mn, P, B, Bi, Cr, Sc, Y, REM, Hf, and C in a total amount of 0.0001 to 2 mass %. The temperature of the hot-dip plating bath 2 varies depending on the composition, but is preferably, for example, in a range of 400 to 500° C. This is because when the temperature of the hot-dip plating bath 2 is in this range, a desired hot-dip plated layer can be formed.

The cooling device 5 cools the hot-dip plating layer, and includes a plurality of cooling nozzles to jet a refrigerant toward the steel member. Examples of the refrigerant include an oxygen-added air, such as 26% oxygen-74% nitrogen.

Hereinafter, the manufacturing method of the hot-dip plated steel member using the production facility of FIG. 1 will be described. The hot-dip plated steel member of the embodiment only has a hot-dip plating layer on the surface of the steel member. For example, the timing of processing the steel sheet is not limited. That is, the hot-dip plated steel member of the embodiment may be obtained by forming a hot-dip plating layer on the surface of a steel sheet/steel material to obtain a plated steel sheet/steel material, and then processing the same. Alternatively, the hot-dip plated steel member of the embodiment may be obtained by forming a hot-dip plating layer on the surface of a steel member processed in advance.

Hereinafter, the manufacturing method will be described, referring to a case where the steel member is a sheet-shaped steel sheet.

First, a hot-rolled steel sheet is manufactured, and hot-band annealing is performed as necessary. After pickling, cold rolling is performed to obtain a cold band. The cold band is degreased and washed with water, and then annealed (cold-band annealing).

Next, as illustrated in FIG. 1, an annealed steel sheet 1 is immersed in the hot-dip galvanizing bath 2, has its traveling direction changed with the sink roll 3, and is pulled up in the vertical direction. The surface of the pulled up steel sheet 1 is sprayed with a high-pressure gas such as air or nitrogen from the wiping nozzle 4 arranged above the hot-dip galvanizing bath 2, thereby removing the excessive adhesion amount of the hot-dip plating adhering to the surface of the steel sheet 1.

The adhesion amount of the hot-dip plating layer is preferably adjusted so that the total adhesion amount on both surfaces of the steel sheet falls within the range of 30 to 600 g/m$^2$. When the adhesion amount is less than 30 g/m$^2$, the corrosion resistance of the hot-dip plated steel sheet is deteriorated, which is not preferable. When the adhesion amount exceeds 600 g/m$^2$, molten metal adhered to the steel sheet drips, and the surface of the hot-dip plating layer cannot be made smooth, which is not preferable. When the steel member is not sheet-shaped, the adhesion amount of the hot-dip plating layer is preferably adjusted so that the total is 30 to 600 g/m$^2$ throughout the entire steel member.

Next, as illustrated in FIG. 1, the hot-dip plating layer adhering to the surface of the steel sheet 1 is cooled by the cooling device 5 including a plurality of jetting nozzles. The refrigerant is not jetted from all the jetting nozzles at the same time, but the jetting nozzles for jetting the refrigerant are randomly switched while the refrigerant is jetted from some of the jetting nozzles. From the jetting nozzle, an oxygen-added air refrigerant, such as 26% oxygen-74% nitrogen, is jetted as the refrigerant.

In the portion where the refrigerant is jetted, surface oxidation of the hot-dip plating layer is promoted, and white portions are easily formed. On the other hand, in the portion where the refrigerant is not jetted, the cooling rate of the hot-dip plating layer is low, and glossy portions are easily formed. In this manner, by randomly switching the jetting nozzles for jetting the refrigerant, a desired hot-dip plated steel member can be obtained. The plurality of jetting nozzles is preferably arranged at intervals of 25 mm. The jetting nozzles are adjusted so that the jetting nozzles are switched ON and OFF at intervals of 0.1 seconds, and randomly switched by using random numbers to jet the refrigerant from 30 to 60% of all of the jetting nozzles. The refrigerant flow rate is adjusted such that the average cooling rate of the entire steel sheet is 5 to 20° C./s.

The above cooling control on the hot-dip plating layer may be performed, for example, only on the hot-dip plating layer arranged on a first surface side of the steel sheet, or on the hot-dip plating layers arranged on both a first surface side and a second surface side of the steel sheet.

When the steel sheet is cooled after hot-dip plating, cooling is usually performed under the same conditions on the first surface side and the second surface side of the steel sheet. Therefore, the total area ratio of white pixels, included in the binarized image data obtained from the image data captured from both surface sides of the steel sheet, satisfies 30% or more and 70% or less. On the other hand, when the first surface side of the steel sheet is cooled under the above-described preferable conditions and the second surface side is cooled under conditions deviating from the preferable conditions, the total area ratio of white pixels, included in the binarized image data obtained from the image data captured from one of both surface sides of the steel sheet, can satisfy 30% or more and 70% or less.

The chemical conversion treatment layer may be further formed on the cooled hot-dip plating layer. In the coating method with an aqueous composition to be used for forming a chemical conversion treatment layer, the aqueous composition is applied on the surface of the hot-dip plating layer to form a film. The coating method is not particularly limited, and commonly used roll coating, air spraying, airless spraying, immersion, and the like can be appropriately adopted. As the drying method after applying the aqueous composition, any one of hot air, induction heating, near infrared, far infrared, and the like may be used, or these methods may be used in combination. The heating temperature of the object to be coated is 50 to 250° C., preferably 70 to 220° C.

According to the hot-dip plated steel member of the embodiment, the total area ratio of white pixels included in the binarized image data, the binarized image data obtained by using Otsu's method and binarizing the image data obtained by imaging the surface of the hot-dip plating layer, is 30% or more and 70% or less. Therefore, it is possible to improve the corrosion resistance of the hot-dip plated steel member and the adhesion of the chemical conversion treatment layer, enhance conductivity with a welding electrode, and further obtain an excellent external appearance.

EXAMPLES

Next, examples of the present invention will be described. In the following examples, the present invention will be described, referring to a case where the steel member is a sheet-shaped steel sheet.

A steel sheet after cold rolling was degreased and washed with water. Thereafter, the steel sheet was subjected to cold-band annealing. The steel sheet after cold-band annealing was immersed in a hot-dip plating bath and then pulled up. Thereafter, the adhesion amount was adjusted by gas wiping, and cooling was further performed to form a hot-dip plating layer on the steel sheet. In this way, samples (hot-dip plated steel members) of No. 1 to 110 shown in Tables 1A to 3C were manufactured.

For some samples, a chemical conversion treatment layer was formed on the surface of the hot-dip plating layer after the hot-dip plating layer was formed. As the coating method with an aqueous composition to be used for forming a chemical conversion treatment layer, the aqueous composition was applied on the surface of the hot-dip plating layer by roll coating. The drying after application was hot air drying. The heating temperature of the object to be coated was 50 to 250° C. The chemical conversion treatment layer was a layer containing 20 mass % or more of a resin and 1 to 20 mass % of a silica particle having a particle diameter of 5 to 200 nm. The adhesion amount of the chemical conversion treatment layer was in a range of 0.1 to 15 g/m$^2$. Except for No. 97, the formed chemical conversion treatment layer was colorless and transparent as long as it was visually observed.

The composition of the hot-dip plating layer was measured by the following method. First, a sample was collected from the hot-dip plated steel member by cutting a 50 mm×50 mm rectangular region that was 50 mm distant from the edge and had no obvious defect such as corrosion. Next, using a coating film release agent that does not erode the plating (NEOREVER SP-751, manufactured by SANSAIKAKO), the surface coating film and the chemical conversion treatment layer were removed from the sample. When the coating film layer and the chemical conversion treatment layer as the surface layer were insufficiently removed, they were removed in combination with polishing with a polishing agent that was less hard than the plating layer. Thereafter, the sample was immersed in 5% hydrochloric acid containing an inhibitor (HIBIRON, manufactured by SUGIMURA Chemical Industrial Co., Ltd.) to dissolve the hot-dip plating layer. The composition of the hot-dip plating layer was determined by subjecting the obtained solution to inductively coupled plasma (ICP) emission spectrometry. However, Si, which was not accurately analyzed by the above method, was determined by analyzing the obtained solution after treatment by Decomposition with acids and fusion with sodium carbonate based on JIS G1258-3. The average composition of the hot-dip plating layer was almost the same as the composition of the hot-dip plating bath except for Fe. The Fe content in the hot-dip plating layer was 0.0001 to 2 mass % in all of the examples.

For cooling after gas wiping, a cooling device having a plurality of cooling nozzles to jet a refrigerant toward one surface and the other surface of the steel sheet was used. The plurality of jetting nozzles was arranged at intervals of 25 mm. As the refrigerant, a gas obtained by adding oxygen to air to form a composition of 26% oxygen-74% nitrogen was used. For cooling, the refrigerant was not jetted from all the jetting nozzles at the same time, but the jetting nozzles for jetting the refrigerant were randomly switched while the refrigerant was jetted from some of the jetting nozzles. The jetting nozzles were switched ON and OFF at intervals of 0.1 seconds, and randomly switched by using random numbers to jet the refrigerant from 30 to 60% of all of the jetting nozzles. The refrigerant flow rate was adjusted such that the average cooling rate of the entire steel sheet was 5 to 20° C./s.

However, for No. 103 and 109, cooling after gas wiping was performed under conventional conditions. That is, the refrigerant was air itself, to which no additional oxygen was added. In addition, random ON/OFF of the jetting nozzle was not performed. The refrigerant flow rate was adjusted such that the average cooling rate of the entire steel sheet was 5 to 20° C./s.

For No. 104 and 110, cooling was performed using a gas produced by adding oxygen to air and having a composition of 26% oxygen-74% nitrogen. For cooling, the refrigerant was not jetted from all the jetting nozzles at the same time, but the jetting nozzles for jetting the refrigerant were randomly switched while the refrigerant was jetted from some of the jetting nozzles. The jetting nozzles were switched ON and OFF at intervals of 0.1 seconds, and randomly switched by using random numbers to jet the refrigerant from 80% of all of the jetting nozzles. The refrigerant flow rate was adjusted such that the average cooling rate of the entire steel sheet was 5 to 20° C./s.

Further, for No. 97, the chemical conversion treatment layer contained a white pigment to become an opaque chemical conversion treatment layer. In addition, in No. 97, the total area ratio of white pixels and glossiness were evaluated before the chemical conversion treatment layer was formed, corrosion resistance, adhesion, and conductivity described below were evaluated after the chemical conversion treatment layer was formed, and external appearance evaluation and evaluation of conspicuousness of defects were omitted.

In the hot-dip plating layer on a first surface side of the obtained hot-dip plated steel member, a rectangular region having a side length of 100 mm was set as an imaging region. A sample including the set imaging region and the periphery thereof was cut out from the hot-dip plated steel member. Then, the image data was acquired by scanning the surface of the hot-dip plating layer of the cut-out sample with a flatbed scanner connected to a computer. The samples having a chemical conversion treatment layer were scanned from above the chemical conversion treatment layer to obtain image data. The image data was extracted as image data of 256 gradation in gray scale with a resolution of 300 dpi. When a local brightness spot occurs in the image data, the local brightness spot was eliminated by image correction.

Next, the obtained image data was binarized by above-described Otsu's method to obtain binarized image data. The binarization by Otsu's method was performed by a computer incorporating the program in advance. Then, the total area ratio of white pixels in the binarized image data was determined. The results are shown in Tables 2A to 2C.

(Metallic External Appearance)

The metallic external appearance was evaluated by determining how the external appearance of the surface was visually observed when the surface of the hot-dip plating layer of the hot-dip plated steel member was shown to five panelists. That is, the metallic external appearance was evaluated by determining whether each panelist visually observed the metallic external appearance of the surface of the plating layer. The evaluation was determined by the following rating, and a score of 3 or 2 was regarded as pass. The results are shown in Tables 3A to 3C.

3: Three or more of five people visually observed the metallic external appearance of the plating.

2: Two of five people visually observed the metallic external appearance of the plating.

1: One or less of five people visually observed the metallic external appearance of the plating.

(60 Degree Specular Gloss Gs (60°))

In accordance with the method specified in JIS Z 8741, 60° glossiness (%) was measured using a gloss meter for each of a region corresponding to an aggregate region of white pixels and a region corresponding to an aggregate region of black pixels in the hot-dip plating layer. The 60 degree specular gloss Gs (60°) was calculated from the obtained 60° glossiness (%) based on the description of JIS Z 8741.

The aggregate region of white pixels was defined as a rectangular region of 3 mm square, the region including white pixels in an area ratio of 60% or more in the binarized image data. The aggregate region of black pixels was defined as a rectangular region of 3 mm square, the region including black pixels in an area ratio of 60% or more in the binarized image data.

(External Appearance Evaluation)

The inconspicuousness of defects was visually evaluated. The plating appearance was visually evaluated. Specifically, when the surface of the plating layer was scratched, and then the scratch was not visually observed from a 2 meters distant place, it was determined that the scratch was inconspicuous, and evaluated as F. On the other hand, when the scratch was visually observed even from a 2 meters distant place, it was determined that the scratch was not inconspicuous, and evaluated as P. F was regarded as pass.

(Corrosion Resistance)

The corrosion resistance of the hot-dip plated steel member was evaluated by the corrosion loss after a CCT test. The hot-dip plated steel member was cut into 150×70 mm, and the corrosion loss after 30 cycles of CCT was investigated using CCT in accordance with JASO-M609. A corrosion loss of less than 30 g/m$^2$ was evaluated as F, a corrosion loss of 30 g/m$^2$ or more and less than 50 g/m$^2$ was evaluated as G, a corrosion loss of 50 g/m$^2$ or more was evaluated as P, and F and G were evaluated as pass. The results are shown in Tables 3A to 3C. When a chemical conversion treatment layer was present, corrosion resistance was evaluated after removing the same.

(Adhesion)

The adhesion of the chemical conversion treatment layer was evaluated as follows. First, a test piece was immersed in boiling water for 30 minutes, then one surface of the test piece was cut in a checkerboard pattern at intervals of 1 mm, and the percentage of the number of squares on which the chemical conversion treatment layer remained without peeling (remaining numbers/cut numbers (100)) was investigated. That is, the adhesion of the chemical conversion treatment layer was evaluated in terms of the percentage of the number of squares on which the chemical conversion treatment layer was not peeled out of the 100 squares. Peeling of the chemical conversion treatment layer was observed with a scanning electron microscope. The evaluation criteria for adhesion were as follows, and F and G were determined as pass.

<Evaluation Criteria>

F=95% or more

G=90% or more and less than 95%

P=less than 90%

(Conductivity)

The conductivity was evaluated as follows. First, a test piece was cut out from the hot-dip plated steel member on which the chemical conversion treatment layer was formed. Thereafter, using the obtained test piece, the interlayer resistance value (Ω·cm$^2$) was measured in accordance with Methods of test for the determination of surface insulation resistance of electrical strip and sheet, which is specified in JIS C 2550:2019. The test voltage was 0.5 V, the measurement current range was 0 to 1 A, the contact area of the 10 contact electrodes was 1 cm$^2$×10, and the test pressure was 2 N/mm$^2$±5%. The interlayer resistance value of less than 5 Ω·cm$^2$ was defined as P, the value of 5 Ω·cm$^2$ or more and less than 7 Ω·cm$^2$ was defined as G, and the value of 7 Ω·cm$^2$ or more was defined as F.

As shown in Tables 1A to 3C, No. 1 to 48 are examples in which the chemical conversion treatment layer was not formed. In No. 1 to 48, since the chemical composition of the hot-dip plating layer satisfied the scope of the present invention and the manufacturing conditions were in the preferable range, the total area ratio of white pixels was in the range of 30 to 70%, and thus a good external appearance was exhibited. The corrosion resistance was also excellent.

As shown in Tables 1B to 3C, No. 49 to 98 are examples in which the chemical conversion treatment layer was formed. In No. 49 to 98, since the chemical composition of the hot-dip plating layer satisfied the scope of the present invention and the manufacturing conditions were in the preferable range, the total area ratio of white pixels was in the range of 30 to 70%, and thus a good external appearance was exhibited. The corrosion resistance was also excellent. Furthermore, since the chemical conversion treatment layer was excellent in adhesion and the interlayer resistance was low, the conductivity with a welding electrode was improved and the weldability was also excellent. In No. 99 to 102, the chemical conversion treatment layer was not formed. In No. 99 to 102, since the chemical composition of the hot-dip plating layer was out of the scope of the present invention, corrosion resistance was reduced.

In No. 103, the chemical conversion treatment layer was not formed. Although the chemical composition of the hot-dip plating layer satisfied the scope of the present invention, the cooling condition after hot-dip plating was a conventional cooling condition. Therefore, in No. 103, the total area ratio of white pixels was less than 30%, and defects were easily noticeable.

In No. 104, the chemical conversion treatment layer was not formed. Although the chemical composition of the hot-dip plating layer satisfied the scope of the present invention, the cooling condition after hot-dip plating was out of the preferable cooling condition. Therefore, in No. 104, the total area ratio of white pixels was more than 70%, thereby failing to obtain metallic external appearance and exhibiting deteriorated external appearance.

In No. 105 to 108, the chemical conversion treatment layer was formed. In No. 105 to 108, since the chemical composition of the hot-dip plating layer was out of the scope of the present invention, corrosion resistance was reduced.

In No. 109, the chemical conversion treatment layer was formed. Although the chemical composition of the hot-dip plating layer satisfied the scope of the present invention, the cooling condition after hot-dip plating was a conventional cooling condition. Therefore, in No. 109, the total area ratio of white pixels was less than 30%, and defects were easily noticeable. In addition, the adhesion of the chemical conversion treatment layer was deteriorated.

In No. 110, the chemical conversion treatment layer was formed. Although the chemical composition of the hot-dip plating layer satisfied the scope of the present invention, the cooling condition after hot-dip plating was out of the preferable cooling condition. Therefore, in No. 110, the total area ratio of white pixels was more than 70%, thereby failing to obtain metallic external appearance and exhibiting deteriorated external appearance. In addition, the conductivity was reduced, and the weldability was deteriorated.

TABLE 1A

| | | Chemical conversion treatment layer | Hot-dip plating layer | | | | |
|---|---|---|---|---|---|---|---|
| | Manufacturing | Presence or absence of chemical conversion | Average composition(mass %) balance: Zn and impurities | | | | Adhesion amount of plating (both surfaces) |
| No. | method | treatment layer | Al | Mg | Si | Others | (g/m$^2$) |
| 1 | Local jetting nozzle | Absent | 11 | 3.0 | — | — | 160 |
| 2 | Local jetting nozzle | Absent | 4 | 3.0 | — | — | 30 |
| 3 | Local jetting nozzle | Absent | 5 | 3.0 | — | — | 90 |
| 4 | Local jetting nozzle | Absent | 6 | 3.0 | — | — | 40 |
| 5 | Local jetting nozzle | Absent | 19 | 3.0 | — | — | 50 |
| 6 | Local jetting nozzle | Absent | 21 | 3.0 | — | — | 250 |
| 7 | Local jetting nozzle | Absent | 22 | 3.0 | — | — | 300 |
| 8 | Local jetting nozzle | Absent | 11 | 1.0 | — | — | 270 |
| 9 | Local jetting nozzle | Absent | 11 | 1.5 | — | — | 210 |
| 10 | Local jetting nozzle | Absent | 11 | 2 | — | — | 80 |
| 11 | Local jetting nozzle | Absent | 11 | 7.0 | — | — | 260 |
| 12 | Local jetting nozzle | Absent | 11 | 8.0 | — | — | 100 |
| 13 | Local jetting nozzle | Absent | 11 | 10.0 | — | — | 50 |
| 14 | Local jetting nozzle | Absent | 11 | 3.0 | 0.0001 | — | 60 |
| 15 | Local jetting nozzle | Absent | 11 | 3.0 | 0.001 | — | 150 |
| 16 | Local jetting nozzle | Absent | 11 | 3.0 | 0.01 | — | 210 |
| 17 | Local jetting nozzle | Absent | 11 | 3.0 | 0.2 | — | 230 |
| 18 | Local jetting nozzle | Absent | 11 | 3.0 | 0.8 | — | 40 |
| 19 | Local jetting nozzle | Absent | 11 | 3.0 | 1 | — | 40 |
| 20 | Local jetting nozzle | Absent | 11 | 3.0 | 2 | — | 260 |
| 21 | Local jetting nozzle | Absent | 11 | 3.0 | — | Ni 0.01% | 220 |
| 22 | Local jetting nozzle | Absent | 11 | 3.0 | — | Ti 0.01% | 110 |
| 23 | Local jetting nozzle | Absent | 11 | 3.0 | — | Zr 0.01% | 220 |
| 24 | Local jetting nozzle | Absent | 11 | 3.0 | — | Sr 0.01% | 200 |
| 25 | Local jetting nozzle | Absent | 11 | 3.0 | — | Sb 0.01% | 250 |
| 26 | Local jetting nozzle | Absent | 11 | 3.0 | — | Pb 0.01% | 220 |
| 27 | Local jetting nozzle | Absent | 11 | 3.0 | — | Sn 0.01% | 100 |
| 28 | Local jetting nozzle | Absent | 11 | 3.0 | — | Ca 0.01% | 130 |
| 29 | Local jetting nozzle | Absent | 11 | 3.0 | — | Co 0.01% | 240 |
| 30 | Local jetting nozzle | Absent | 11 | 3.0 | — | Mn 0.01% | 210 |
| 31 | Local jetting nozzle | Absent | 11 | 3.0 | — | P 0.01% | 80 |
| 32 | Local jetting nozzle | Absent | 11 | 3.0 | — | B 0.01% | 80 |
| 33 | Local jetting nozzle | Absent | 11 | 3.0 | — | Bi 0.01% | 70 |
| 34 | Local jetting nozzle | Absent | 11 | 3.0 | — | Cr 0.01% | 250 |
| 35 | Local jetting nozzle | Absent | 11 | 3.0 | — | Sc 0.01% | 230 |
| 36 | Local jetting nozzle | Absent | 11 | 3.0 | — | Y 0.01% | 110 |
| 37 | Local jetting nozzle | Absent | 11 | 3.0 | — | REM 0.01% | 190 |
| 38 | Local jetting nozzle | Absent | 11 | 3.0 | — | Hf 0.01% | 130 |
| 39 | Local jetting nozzle | Absent | 11 | 3.0 | — | C 0.01% | 100 |
| 40 | Local jetting nozzle | Absent | 11 | 3.0 | 0.2 | Ti 0.01% | 270 |

TABLE 1B

| No. | Manufacturing method | Chemical conversion treatment layer: Presence or absence of chemical conversion treatment layer | Hot-dip plating layer: Average composition(mass %) balance: Zn and impurities: Al | Mg | Si | Others | Adhesion amount of plating (both surfaces) ($g/m^2$) |
|---|---|---|---|---|---|---|---|
| 41 | Local jetting nozzle | Absent | 11 | 3.0 | 0.2 | Ni 0.01% | 230 |
| 42 | Local jetting nozzle | Absent | 11 | 3.0 | — | Ti 0.01% REM 0.01% | 140 |
| 43 | Local jetting nozzle | Absent | 11 | 3.0 | 0.2 | Ti 0.01% REM 0.01% | 100 |
| 44 | Local jetting nozzle | Absent | 4 | 3.0 | — | — | 140 |
| 45 | Local jetting nozzle | Absent | 4 | 3.0 | — | — | 80 |
| 46 | Local jetting nozzle | Absent | 4 | 3.0 | — | — | 70 |
| 47 | Local jetting nozzle | Absent | 4 | 3.0 | — | — | 60 |
| 48 | Local jetting nozzle | Absent | 4 | 1.0 | — | — | 290 |
| 49 | Local jetting nozzle | Present | 11 | 3.0 | — | — | 110 |
| 50 | Local jetting nozzle | Present | 4 | 3.0 | — | — | 100 |
| 51 | Local jetting nozzle | Present | 5 | 3.0 | — | — | 200 |
| 52 | Local jetting nozzle | Present | 6 | 3.0 | — | — | 180 |
| 53 | Local jetting nozzle | Present | 19 | 3.0 | — | — | 100 |
| 54 | Local jetting nozzle | Present | 21 | 3.0 | — | — | 130 |
| 55 | Local jetting nozzle | Present | 22 | 3.0 | — | — | 90 |
| 56 | Local jetting nozzle | Present | 11 | 1.0 | — | — | 110 |
| 57 | Local jetting nozzle | Present | 11 | 1.5 | — | — | 40 |
| 58 | Local jetting nozzle | Present | 11 | 2.0 | — | — | 40 |
| 59 | Local jetting nozzle | Present | 11 | 7.0 | — | — | 70 |
| 60 | Local jetting nozzle | Present | 11 | 8.0 | — | — | 150 |
| 61 | Local jetting nozzle | Present | 11 | 10.0 | — | — | 90 |
| 62 | Local jetting nozzle | Present | 11 | 3.0 | 0.0001 | — | 60 |
| 63 | Local jetting nozzle | Present | 11 | 3.0 | 0.001 | — | 170 |
| 64 | Local jetting nozzle | Present | 11 | 3.0 | 0.01 | — | 140 |
| 65 | Local jetting nozzle | Present | 11 | 3.0 | 0.2 | — | 70 |
| 66 | Local jetting nozzle | Present | 11 | 3.0 | 0.8 | — | 140 |
| 67 | Local jetting nozzle | Present | 11 | 3.0 | 1 | — | 100 |
| 68 | Local jetting nozzle | Present | 11 | 3.0 | 2 | — | 110 |
| 69 | Local jetting nozzle | Present | 11 | 3.0 | — | Ni 0.01% | 80 |
| 70 | Local jetting nozzle | Present | 11 | 3.0 | — | Ti 0.01% | 170 |
| 71 | Local jetting nozzle | Present | 11 | 3.0 | — | Zr 0.01% | 120 |
| 72 | Local jetting nozzle | Present | 11 | 3.0 | — | Sr 0.01% | 50 |
| 73 | Local jetting nozzle | Present | 11 | 3.0 | — | Sb 0.01% | 140 |
| 74 | Local jetting nozzle | Present | 11 | 3.0 | — | Pb 0.01% | 130 |
| 75 | Local jetting nozzle | Present | 11 | 3.0 | — | Sn 0.01% | 180 |
| 76 | Local jetting nozzle | Present | 11 | 3.0 | — | Ca 0.01% | 40 |
| 77 | Local jetting nozzle | Present | 11 | 3.0 | — | Co 0.01% | 190 |
| 78 | Local jetting nozzle | Present | 11 | 3.0 | — | Mn 0.01% | 190 |
| 79 | Local jetting nozzle | Present | 11 | 3.0 | — | P 0.01% | 160 |
| 80 | Local jetting nozzle | Present | 11 | 3.0 | — | B 0.01% | 100 |

TABLE 1C

| No. | Manufacturing method | Chemical conversion treatment layer: Presence or absence of chemical conversion treatment layer | Hot-dip plating layer: Average composition(mass %) balance: Zn and impurities: Al | Mg | Si | Others | Adhesion amount of plating (both surfaces) ($g/m^2$) |
|---|---|---|---|---|---|---|---|
| 81 | Local jetting nozzle | Present | 11 | 3.0 | — | Bi 0.01% | 160 |
| 82 | Local jetting nozzle | Present | 11 | 3.0 | — | Cr 0.01% | 140 |
| 83 | Local jetting nozzle | Present | 11 | 3.0 | — | Sc 0.01% | 190 |
| 84 | Local jetting nozzle | Present | 11 | 3.0 | — | Y 0.01% | 40 |
| 85 | Local jetting nozzle | Present | 11 | 3.0 | — | REM 0.01% | 80 |
| 86 | Local jetting nozzle | Present | 11 | 3.0 | — | Hf 0.01% | 110 |
| 87 | Local jetting nozzle | Present | 11 | 3.0 | — | C 0.01% | 60 |
| 88 | Local jetting nozzle | Present | 11 | 3.0 | 0.2 | Ti 0.01% | 80 |
| 89 | Local jetting nozzle | Present | 11 | 3.0 | 0.2 | Ni 0.01% | 120 |

TABLE 1C-continued

| No. | Manufacturing method | Chemical conversion treatment layer: Presence or absence of chemical conversion treatment layer | Hot-dip plating layer: Average composition(mass %) balance: Zn and impurities: Al | Mg | Si | Others | Adhesion amount of plating (both surfaces) (g/m$^2$) |
|---|---|---|---|---|---|---|---|
| 90 | Local jetting nozzle | Present | 11 | 3.0 | — | Ti 0.01% REM 0.01% | 140 |
| 91 | Local jetting nozzle | Present | 11 | 3.0 | 0.2 | Ti 0.01% REM 0.01% | 100 |
| 92 | Local jetting nozzle | Present | 4 | 3.0 | — | — | 130 |
| 93 | Local jetting nozzle | Present | 4 | 3.0 | — | — | 100 |
| 94 | Local jetting nozzle | Present | 4 | 3.0 | — | — | 190 |
| 95 | Local jetting nozzle | Present | 4 | 3.0 | — | — | 100 |
| 96 | Local jetting nozzle | Present | 4 | 3.0 | — | — | 120 |
| 97 | Local jetting nozzle | Present | 11 | 3.0 | — | — | 110 |
| 98 | Local jetting nozzle | Present | 4 | 1.0 | — | — | 290 |
| 99 | Local jetting nozzle | Absent | 3 | 3.0 | — | — | 40 |
| 100 | Local jetting nozzle | Absent | 23 | 3.0 | — | — | 160 |
| 101 | Local jetting nozzle | Absent | 11 | 0.5 | — | — | 80 |
| 102 | Local jetting nozzle | Absent | 11 | 11.0 | — | — | 100 |
| 103 | Conventional nozzle | Absent | 11 | 3.0 | — | — | 120 |
| 104 | Excessive output number of Local jetting nozzle | Absent | 11 | 3.0 | — | — | 140 |
| 105 | Local jetting nozzle | Present | 3 | 3.0 | — | — | 40 |
| 106 | Local jetting nozzle | Present | 23 | 3.0 | — | — | 160 |
| 107 | Local jetting nozzle | Present | 11 | 0.5 | — | — | 80 |
| 108 | Local jetting nozzle | Present | 11 | 11.0 | — | — | 100 |
| 109 | Conventional nozzle | Present | 11 | 3.0 | — | — | 120 |
| 110 | Excessive output number of Local jetting nozzle | Present | 11 | 3.0 | — | — | 140 |

Underlines indicate that the item is out of the scope of the present invention.

TABLE 2A

| No. | Hot-dip plating layer: Total area ratio of white pixels (area %) | Presence or absence of metallic external appearance | 60 degree specular gloss Gs(60°): Aggregate region of white pixels (W) | Aggregate region of black pixels (B) | Magnification (B/W) |
|---|---|---|---|---|---|
| 1 | 65 | Present | 60 | 110 | 1.8 |
| 2 | 45 | Present | 40 | 80 | 2.1 |
| 3 | 55 | Present | 50 | 90 | 1.7 |
| 4 | 55 | Present | 60 | 110 | 1.9 |
| 5 | 60 | Present | 40 | 80 | 2.0 |
| 6 | 45 | Present | 50 | 90 | 1.7 |
| 7 | 65 | Present | 50 | 80 | 1.6 |
| 8 | 45 | Present | 40 | 80 | 2.1 |
| 9 | 35 | Present | 40 | 70 | 1.7 |
| 10 | 55 | Present | 70 | 110 | 1.6 |
| 11 | 60 | Present | 40 | 100 | 2.4 |
| 12 | 40 | Present | 60 | 110 | 1.9 |
| 13 | 35 | Present | 40 | 90 | 2.2 |
| 14 | 40 | Present | 50 | 100 | 2.0 |
| 15 | 60 | Present | 40 | 80 | 1.9 |
| 16 | 55 | Present | 40 | 100 | 2.4 |
| 17 | 55 | Present | 50 | 110 | 2.1 |
| 18 | 50 | Present | 50 | 100 | 2.0 |
| 19 | 45 | Present | 40 | 90 | 2.2 |
| 20 | 50 | Present | 50 | 110 | 2.1 |
| 21 | 40 | Present | 60 | 110 | 1.8 |
| 22 | 55 | Present | 60 | 110 | 1.9 |
| 23 | 45 | Present | 50 | 100 | 1.9 |
| 24 | 65 | Present | 50 | 110 | 2.1 |
| 25 | 60 | Present | 60 | 110 | 1.9 |

TABLE 2A-continued

| No. | Hot-dip plating layer: Total area ratio of white pixels (area %) | Presence or absence of metallic external appearance | 60 degree specular gloss Gs(60°): Aggregate region of white pixels (W) | Aggregate region of black pixels (B) | Magnification (B/W) |
|---|---|---|---|---|---|
| 26 | 50 | Present | 50 | 110 | 2.1 |
| 27 | 45 | Present | 50 | 110 | 2.1 |
| 28 | 65 | Present | 40 | 80 | 2.0 |
| 29 | 65 | Present | 70 | 110 | 1.6 |
| 30 | 40 | Present | 50 | 80 | 1.6 |
| 31 | 35 | Present | 60 | 130 | 2.2 |
| 32 | 65 | Present | 60 | 120 | 2.0 |
| 33 | 50 | Present | 70 | 110 | 1.6 |
| 34 | 50 | Present | 40 | 80 | 1.9 |
| 35 | 65 | Present | 70 | 130 | 1.9 |
| 36 | 45 | Present | 60 | 120 | 2.0 |
| 37 | 50 | Present | 40 | 70 | 1.7 |
| 38 | 40 | Present | 70 | 130 | 1.9 |
| 39 | 40 | Present | 50 | 130 | 2.5 |
| 40 | 55 | Present | 70 | 150 | 2.2 |

TABLE 2B

| | Hot-dip plating layer | | | | |
|---|---|---|---|---|---|
| | | | 60 degree specular gloss Gs(60°) | | |
| No. | Total area ratio of white pixels (area %) | Presence or absence of metallic external appearance | Aggregate region of white pixels (W) | Aggregate region of black pixels (B) | Magnification (B/W) |
| 41 | 65 | Present | 50 | 110 | 2.2 |
| 42 | 60 | Present | 50 | 130 | 2.5 |
| 43 | 65 | Present | 60 | 140 | 2.4 |
| 44 | 30 | Present | 70 | 140 | 2.0 |
| 45 | 70 | Present | 60 | 130 | 2.2 |
| 46 | 60 | Present | 50 | 150 | 2.2 |
| 47 | 40 | Present | 40 | 60 | 1.5 |
| 48 | 50 | Present | 160 | 240 | 1.5 |
| 49 | 35 | Present | 70 | 110 | 1.6 |
| 50 | 65 | Present | 70 | 130 | 1.9 |
| 51 | 65 | Present | 50 | 110 | 2.1 |
| 52 | 65 | Present | 70 | 140 | 2.0 |
| 53 | 55 | Present | 40 | 60 | 1.6 |
| 54 | 35 | Present | 50 | 100 | 1.9 |
| 55 | 55 | Present | 40 | 100 | 2.4 |
| 56 | 35 | Present | 70 | 130 | 1.9 |
| 57 | 55 | Present | 40 | 90 | 2.3 |
| 58 | 40 | Present | 70 | 140 | 2.0 |
| 59 | 40 | Present | 50 | 100 | 2.0 |
| 60 | 65 | Present | 40 | 100 | 2.5 |
| 61 | 60 | Present | 60 | 130 | 2.1 |
| 62 | 65 | Present | 70 | 140 | 2.0 |
| 63 | 65 | Present | 50 | 90 | 1.8 |
| 64 | 35 | Present | 40 | 100 | 2.5 |
| 65 | 50 | Present | 40 | 100 | 2.4 |
| 66 | 55 | Present | 40 | 90 | 2.3 |
| 67 | 50 | Present | 40 | 60 | 1.6 |
| 68 | 40 | Present | 40 | 60 | 1.6 |
| 69 | 50 | Present | 50 | 130 | 2.5 |
| 70 | 50 | Present | 70 | 130 | 1.9 |
| 71 | 60 | Present | 40 | 90 | 2.2 |
| 72 | 65 | Present | 40 | 70 | 1.7 |
| 73 | 35 | Present | 70 | 130 | 1.8 |
| 74 | 50 | Present | 40 | 90 | 2.3 |
| 75 | 50 | Present | 70 | 130 | 1.8 |
| 76 | 65 | Present | 60 | 130 | 2.1 |
| 77 | 40 | Present | 40 | 70 | 1.7 |
| 78 | 55 | Present | 60 | 130 | 2.2 |
| 79 | 40 | Present | 60 | 110 | 1.8 |
| 80 | 35 | Present | 60 | 100 | 1.6 |

TABLE 2C

| | Hot-dip plating layer | | | | |
|---|---|---|---|---|---|
| | | | 60 degree specular gloss Gs(60°) | | |
| No. | Total area ratio of white pixels (area %) | Presence or absence of metallic external appearance | Aggregate region of white pixels (W) | Aggregate region of black pixels (B) | Magnification (B/W) |
| 81 | 40 | Present | 40 | 60 | 1.6 |
| 82 | 45 | Present | 60 | 130 | 2.2 |
| 83 | 45 | Present | 70 | 140 | 2.0 |
| 84 | 65 | Present | 60 | 130 | 2.1 |
| 85 | 50 | Present | 60 | 120 | 2.0 |
| 86 | 50 | Present | 50 | 100 | 2.0 |
| 87 | 60 | Present | 60 | 130 | 2.2 |
| 88 | 65 | Present | 50 | 120 | 2.4 |
| 89 | 50 | Present | 70 | 140 | 2.0 |
| 90 | 40 | Present | 50 | 90 | 1.8 |
| 91 | 35 | Present | 60 | 110 | 1.9 |
| 92 | 30 | Present | 50 | 100 | 2.0 |
| 93 | 70 | Present | 40 | 100 | 2.4 |
| 94 | 65 | Present | 50 | 150 | 1.8 |
| 95 | 60 | Present | 50 | 80 | 1.5 |
| 96 | 45 | Present | 70 | 130 | 1.9 |
| 97 | 60 | Present | 60 | 80 | 1.3 |
| 98 | 55 | Present | 160 | 200 | 1.3 |
| 99 | 50 | Present | 60 | 90 | 1.5 |
| 100 | 60 | Present | 70 | 130 | 1.9 |
| 101 | 45 | Present | 60 | 110 | 1.8 |
| 102 | 50 | Present | 40 | 60 | 1.5 |
| 103 | 20 | Present | 60 | 90 | 1.5 |
| 104 | 80 | Present | 30 | 50 | 1.8 |
| 105 | 60 | Present | 50 | 90 | 1.8 |
| 106 | 65 | Present | 40 | 70 | 1.7 |
| 107 | 40 | Present | 70 | 140 | 2.0 |
| 108 | 50 | Present | 40 | 60 | 1.6 |
| 109 | 20 | Present | 80 | 160 | 2.0 |
| 110 | 80 | Present | 40 | 60 | 1.5 |

Underlines indicate that the item is out of the scope of the present invention.

TABLE 3A

| | Evaluation | | | | | |
|---|---|---|---|---|---|---|
| No. | Metallic external appearance | Inconspicuousness of defects | Corrosion resistance | Adhesion | Conductivity | Note |
| 1 | 3 | F | F | — | — | Invention example |
| 2 | 3 | F | G | — | — | |
| 3 | 3 | F | F | — | — | |
| 4 | 3 | F | F | — | — | |
| 5 | 3 | F | F | — | — | |
| 6 | 3 | F | F | — | — | |
| 7 | 3 | F | G | — | — | |
| 8 | 3 | F | G | — | — | |
| 9 | 3 | F | F | — | — | |
| 10 | 3 | F | F | — | — | |
| 11 | 3 | F | F | — | — | |
| 12 | 3 | F | F | — | — | |
| 13 | 3 | F | G | — | — | |
| 14 | 3 | F | F | — | — | |
| 15 | 3 | F | F | — | — | |
| 16 | 3 | F | F | — | — | |
| 17 | 3 | F | F | — | — | |
| 18 | 3 | F | F | — | — | |

TABLE 3A-continued

| No. | Evaluation | | | | | |
|---|---|---|---|---|---|---|
| | Metallic external appearance | Inconspicuousness of defects | Corrosion resistance | Adhesion | Conductivity | Note |
| 19 | 3 | F | F | — | — | |
| 20 | 3 | F | F | — | — | |
| 21 | 3 | F | F | — | — | |
| 22 | 3 | F | F | — | — | |
| 23 | 3 | F | F | — | — | |
| 24 | 3 | F | F | — | — | |
| 25 | 3 | F | F | — | — | |
| 26 | 3 | F | F | — | — | |
| 27 | 3 | F | F | — | — | |
| 28 | 3 | F | F | — | — | |
| 29 | 3 | F | F | — | — | |
| 30 | 3 | F | F | — | — | |
| 31 | 3 | F | F | — | — | |
| 32 | 3 | F | F | — | — | |
| 33 | 3 | F | F | — | — | |
| 34 | 3 | F | F | — | — | |
| 35 | 3 | F | F | — | — | |
| 36 | 3 | F | F | — | — | |
| 37 | 3 | F | F | — | — | |
| 38 | 3 | F | F | — | — | |
| 39 | 3 | F | F | — | — | |
| 40 | 3 | F | F | — | — | |

TABLE 3B

| No. | Evaluation | | | | | |
|---|---|---|---|---|---|---|
| | Metallic external appearance | Inconspicuousness of defects | Corrosion resistance | Adhesion | Conductivity | Note |
| 41 | 3 | F | F | — | — | Invention example |
| 42 | 3 | F | F | — | — | |
| 43 | 3 | F | F | — | — | |
| 44 | 3 | F | F | — | — | |
| 45 | 2 | F | F | — | — | |
| 46 | 3 | F | F | — | — | |
| 47 | 3 | F | F | — | — | |
| 48 | 3 | F | G | — | — | |
| 49 | 3 | F | F | F | F | |
| 50 | 3 | F | G | F | F | |
| 51 | 3 | F | F | F | F | |
| 52 | 3 | F | F | F | F | |
| 53 | 3 | F | F | F | F | |
| 54 | 3 | F | F | F | F | |
| 55 | 3 | F | G | F | F | |
| 56 | 3 | F | G | F | F | |
| 57 | 3 | F | F | F | F | |
| 58 | 3 | F | F | F | F | |
| 59 | 3 | F | F | F | F | |
| 60 | 3 | F | F | F | F | |
| 61 | 3 | F | G | F | F | |
| 62 | 3 | F | F | F | F | |
| 63 | 3 | F | F | F | F | |
| 64 | 3 | F | F | F | F | |
| 65 | 3 | F | F | F | F | |
| 66 | 3 | F | F | F | F | |
| 67 | 3 | F | F | F | F | |
| 68 | 3 | F | F | F | F | |
| 69 | 3 | F | F | F | F | |
| 70 | 3 | F | F | F | F | |
| 71 | 3 | F | F | F | F | |
| 72 | 3 | F | F | F | F | |
| 73 | 3 | F | F | F | F | |

TABLE 3B-continued

| No. | Evaluation | | | | | Note |
|---|---|---|---|---|---|---|
| | Metallic external appearance | Inconspicuousness of defects | Corrosion resistance | Adhesion | Conductivity | |
| 74 | 3 | F | F | F | F | |
| 75 | 3 | F | F | F | F | |
| 76 | 3 | F | F | F | F | |
| 77 | 3 | F | F | F | F | |
| 78 | 3 | F | F | F | F | |
| 79 | 3 | F | F | F | F | |
| 80 | 3 | F | F | F | F | |

TABLE 3C

| No. | Evaluation | | | | | Note |
|---|---|---|---|---|---|---|
| | Metallic external appearance | Inconspicuousness of defects | Corrosion resistance | Adhesion | Conductivity | |
| 81 | 3 | F | F | F | F | Invention |
| 82 | 3 | F | F | F | F | example |
| 83 | 3 | F | F | F | F | |
| 84 | 3 | F | F | F | F | |
| 85 | 3 | F | F | F | F | |
| 86 | 3 | F | F | F | F | |
| 87 | 3 | F | F | F | F | |
| 88 | 3 | F | F | F | F | |
| 89 | 3 | F | F | F | F | |
| 90 | 3 | F | F | F | F | |
| 91 | 3 | F | F | F | F | |
| 92 | 3 | F | F | G | F | |
| 93 | 2 | F | F | F | G | |
| 94 | 3 | F | F | F | F | |
| 95 | 3 | F | F | F | F | |
| 96 | — | — | F | F | F | |
| 97 | 2 | F | F | F | F | |
| 98 | 3 | F | G | G | F | |
| 99 | 3 | F | P | — | — | Comparative |
| 100 | 3 | F | P | — | — | Example |
| 101 | 3 | F | P | — | — | |
| 102 | 3 | F | P | — | — | |
| 103 | 3 | P | F | — | — | |
| 104 | 1 | F | F | — | — | |
| 105 | 3 | F | P | F | F | |
| 106 | 3 | F | P | F | F | |
| 107 | 3 | F | P | F | F | |
| 108 | 3 | F | P | F | F | |
| 109 | 3 | P | F | P | F | |
| 110 | 1 | F | F | F | P | |

Underlines indicate that the item is out of the scope of the present invention.

INDUSTRIAL APPLICABILITY

The Zn—Al—Mg-based hot-dip plated steel member of the present disclosure is excellent in corrosion resistance and adhesion of a chemical conversion treatment layer, is also excellent in conductivity with a welding electrode even when a chemical conversion treatment layer is formed, and has an excellent external appearance in which defects are not easily noticeable, and thus has high industrial applicability.

REFERENCE SIGNS LIST

1 Steel sheet
2 Hot-dip galvanizing bath
3 Sink roll
4 Wiping nozzle
5 Cooling device

The invention claimed is:

1. A Zn—Al—Mg-based hot-dip plated steel member comprising: a steel member; and a hot-dip plating layer arranged on a surface of the steel member, wherein the hot-dip plating layer includes, in terms of mass %,
4 to 22% of Al,
1.0 to 10.0% of Mg,
0.0001 to 2% of Fe,
0 to 2% of Si,
0 to 2% of Ni,
0 to 2% of Ti,
0 to 2% of Zr,
0 to 2% of Sr,
0 to 2% of Sb,
0 to 2% of Pb,
0 to 2% of Sn,
0 to 2% of Ca, 0 to 2% of Co,
0 to 2% of Mn,
0 to 2% of P,
0 to 2% of B,
0 to 2% of Bi,
0 to 2% of Cr,
0 to 2% of Sc,
0 to 2% of Y,
0 to 2% of REM,
0 to 2% of Hf,
0 to 2% of C, and
a balance including Zn and impurities,
in binarized image data of image data obtained by imaging a surface of the hot-dip plating layer, a total area ratio of white pixels is 30% or more and 70% or less,
the binarized image data is obtained by binarizing the image data by Otsu's method,
a 60 degree specular gloss Gs (60°) of a surface of the hot-dip plating layer corresponding to an aggregate region of the white pixels is 50 or less.

2. The Zn—Al—Mg-based hot-dip plated steel member according to claim 1, wherein a chemical conversion treatment layer is included on a surface of the hot-dip plating layer, and
a 60 degree specular gloss Gs (60°) of a surface of the chemical conversion treatment layer corresponding to an aggregate region of the white pixels is 70 or less.

3. The Zn—Al—Mg-based hot-dip plated steel member according to claim 2, wherein the chemical conversion treatment layer has a metallic external appearance.

4. The Zn—Al—Mg-based hot-dip plated steel member according to claim 1, wherein
a 60 degree specular gloss Gs (60°) of a surface of the hot-dip plating layer corresponding to an aggregate region of the white pixels is 150 or less, and
a 60 degree specular gloss Gs (60°) of a surface of the hot-dip plating layer corresponding to an aggregate region of black pixels is 1.5 times or more the 60 degree specular gloss Gs (60°) of the surface of the hot-dip plating layer corresponding to the aggregate region of the white pixels.

5. The Zn—Al—Mg-based hot-dip plated steel member according to claim 2, wherein
a 60 degree specular gloss Gs (60°) of a surface of the hot-dip plating layer corresponding to an aggregate region of the white pixels is 150 or less, and
a 60 degree specular gloss Gs (60°) of a surface of the hot-dip plating layer corresponding to an aggregate region of black pixels is 1.5 times or more the 60 degree specular gloss Gs (60°) of the surface of the hot-dip plating layer corresponding to the aggregate region of the white pixels.

6. The Zn—Al—Mg-based hot-dip plated steel member according to claim 1, wherein
a 60 degree specular gloss Gs (60°) of a surface of the hot-dip plating layer corresponding to an aggregate region of the white pixels is 70 or less, and
a 60 degree specular gloss Gs (60°) of a surface of the hot-dip plating layer corresponding to an aggregate region of black pixels is 1.5 times or more the 60 degree specular gloss Gs (60°) of the surface of the hot-dip plating layer corresponding to the aggregate region of the white pixels.

7. The Zn—Al—Mg-based hot-dip plated steel member according to claim 1, wherein the hot-dip plating layer includes one or two or more selected from groups A, B, and C below:
Group A: 0.0001 to 2% of Si,
Group B: 0.0001 to 2% in total of any one or two or more of Ni, Ti, Zr, and Sr, and
Group C: 0.0001 to 2% in total of any one or two or more of Sb, Pb, Sn, Ca, Co, Mn, P, B, Bi, Cr, Sc, Y, REM, Hf, and C.

8. The Zn—Al—Mg-based hot-dip plated steel member according to claim 7, wherein the hot-dip plating layer includes the group A.

9. The Zn—Al—Mg-based hot-dip plated steel member according to claim 7, wherein the hot-dip plating layer includes the group B.

10. The Zn—Al—Mg-based hot-dip plated steel member according to claim 7, wherein the hot-dip plating layer includes the group C.

* * * * *